US006155526A

United States Patent [19]

Brown

[11] Patent Number: 6,155,526

[45] Date of Patent: Dec. 5, 2000

[54] HANGING DEVICE FOR ORNAMENTS AND OTHER OBJECTS

[76] Inventor: John P. Brown, 217 Duncaster Rd., Bloomfield, Conn. 06002

[21] Appl. No.: 09/274,512

[22] Filed: Mar. 23, 1999

Related U.S. Application Data

[60] Provisional application No. 60/114,488, Dec. 31, 1998.

[51] Int. Cl.[7] ..... A47H 1/16; A47H 1/10; A47B 96/06; A47F 5/00; A47F 5/08

[52] U.S. Cl. ..... 248/303; 248/205.1

[58] Field of Search ..... 248/303, 304, 248/302, 339, 215, 205.1; D8/370

[56] References Cited

U.S. PATENT DOCUMENTS

| | | | |
|---|---|---|---|
| D. 398,516 | 9/1998 | Brown et al. | D8/370 |
| 995,686 | 6/1911 | Koch . | |
| 1,344,027 | 6/1920 | Evilsizor et al. . | |
| 2,100,306 | 11/1937 | McCarthy | 248/303 |
| 2,120,726 | 6/1938 | Baker | 248/302 |
| 2,344,816 | 3/1944 | Hahn | 248/302 |
| 2,454,449 | 11/1948 | Haws et al. | 248/302 |
| 2,506,119 | 5/1950 | Tregar | 248/205.1 |
| 2,544,516 | 3/1951 | Walters | 180/843 |
| 2,555,890 | 6/1951 | Korth | 224/28 |
| 3,223,373 | 12/1965 | Molinaro | 248/339 |
| 3,484,070 | 12/1969 | Horodko et al. | 248/317 |
| 4,887,785 | 12/1989 | Blaich | 248/339 |
| 4,909,466 | 3/1990 | Matthews | 248/303 |
| 4,957,259 | 9/1990 | Wolf, Jr. | 248/304 |
| 4,966,344 | 10/1990 | Gary | 248/317 |
| 5,104,082 | 4/1992 | Bayer | 248/303 |
| 5,141,192 | 8/1992 | Adams | 248/231.81 |
| 5,285,364 | 2/1994 | Bayer | 362/405 |
| 5,383,638 | 1/1995 | Dieringer et al. | 248/317 |
| 5,575,446 | 11/1996 | Swenson et al. | 248/304 |
| 5,624,094 | 4/1997 | Protz, Jr. | 248/231.81 |

*Primary Examiner*—Ramon O. Ramirez
*Assistant Examiner*—Jerome A. DeLuca
*Attorney, Agent, or Firm*—McCormick, Paulding & Huber LLP

[57] ABSTRACT

A hanging device for hanging an object, e.g., a Christmas tree ornament, is presented. The device comprises a locking portion having an end, and a coil spiraling around the end in continuously increasing radii. The device also has an object supporting portion integrally connected to the locking portion opposite the end. As more weight is applied to the device, the coil tends to unwind and tighten around the support member that the device hangs on. Preferably the coil is sized to receive the support member, biasing the support member between successive sections of the coil thereby locking the device on the member. In an exemplary embodiment of the invention, the device is composed of a resilient material, e.g., spring steel wire, to increase the grip of the coil as it unwinds and to help prevent deformation of the device.

19 Claims, 1 Drawing Sheet

HANGING DEVICE FOR ORNAMENTS AND OTHER OBJECTS

This application claims benefit of Provisional application Ser. No. 60/114,488 filed Dec. 31, 1998.

BACKGROUND OF THE INVENTION

The present invention relates generally to a device for hanging objects. More specifically the present invention relates to a device for hanging ornaments, e.g., Christmas ornaments, on a Christmas tree.

There are a large variety of prior art devices for hanging objects, e.g., ornaments, on Christmas tree branches or other similar supports. One such prior art device, commonly known as a Christmas tree hook, is inexpensive, easy to use, and popular. Christmas tree hooks resemble a cursive "J" wherein an open jaw portion hangs on a branch or similar support having generally a round cross sectional shape, and a tightly coiled portion attaches to an ornament. Christmas tree hooks are typically made from a malleable material, and often require a user to bend the jaw portion around a branch in order to secure the Christmas tree hook. Additionally, the tightly coiled, ornament hanger portion of the Christmas tree hook frequently must be uncoiled to attach to an ornament. Another problem with such Christmas tree hooks is that they are easily dislodged from the tree branches, e.g., via children or pets playing, or branches sagging, consequently resulting in ornaments falling to the ground.

Further, the hooks and many other prior art devices lack resiliency and tend to easily deform, especially under the weight of heavier ornaments. This tends to loosen the grip of the hooks on the branches. Because of their malleability, prior art hooks do not resume their original shape unless bent back into position by hand.

Other prior art hanging devices include locking features, e.g., clips or spring biased jaws, to further secure the grip of the hanging device to a branch of a tree or other support. These prior art hanging devices are more expensive, and their locking features require more complex manipulation than a simple hook, e.g., clipping, twisting or spreading apart, in order to attach the ornament to the supporting branch. This can be especially time consuming when hanging a large amount of ornaments.

BRIEF SUMMARY OF THE INVENTION

This invention offers advantages and alternatives over the prior art by providing a hanging device for hanging an object, e.g., a Christmas tree ornament, having a locking portion. Advantageously, the device requires little manipulation to be hung while the locking portion increasingly tightens around a support member, e.g., a Christmas tree branch, as more weight is applied or when there is a jarring of the object.

These and other advantages are accomplished in a preferred form of the invention by providing a hanging device for hanging an object. The device comprises a locking portion having an end, and a coil spiraling around the end in continuously increasing radii. The device also has an object supporting portion integrally connected to the locking portion opposite the end. As more weight is applied to the device, the coil tends to unwind and tighten around the support member that the device hangs on. Preferably the coil is sized to receive the support member, biasing the support member between successive sections of the coil thereby locking the device on the member.

In an exemplary embodiment of the invention, the device is composed of a resilient material, e.g., spring steel wire, to increase the grip of the coil as it unwinds, thus locking and protecting the device from falling, and to help retain the original shape of the device when weight is removed from the device.

BRIEF DESCRIPTION OF THE DRAWINGS

The present invention will now be described, by way of example only, with reference to the accompanying drawings in which.

DETAILED DESCRIPTION OF THE INVENTION

Figure 1:
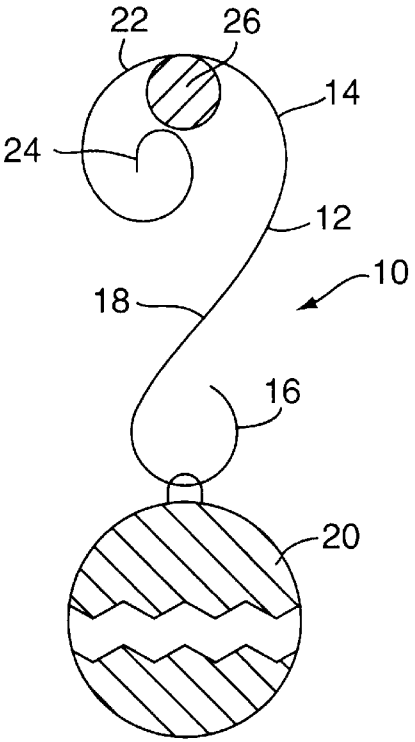
FIG. 1 is a side view of an embodiment of a hanging device in accordance with the present invention.

Referring to FIG. 1 an exemplary embodiment of a device for hanging objects, e.g., Christmas tree ornaments, of the present invention is shown generally at 10. Device 10 is preferably constructed from a length of resilient material, e.g., such as wire hardened to substantially within the range of 80 to 200 pounds per square inch (spring steel wire), stainless steel and certain plastics. In the embodiment shown, device 10 is comprised of spring steel wire approximately 0.039 inches in diameter. Device 10 comprises a locking potion 14, an object supporting portion 16, and a stem portion 18. Object supporting portion 16 is shown by way of example arcuate in shape and forms a circular bend at a distal end of device 10 that is sized to receive a mounting loop of ornament 20. One skilled in the art would recognize that the object supporting portion of the present invention may comprise other shapes, e.g., V-shaped or rectangular, as well as the other suitable alternatives, e.g., clips. In the embodiment shown, stem 18 is substantially straight in shape and integrally connects object supporting section 16 to locking section 14. It is within the scope of the present invention that stem 18 may comprise a plurality of alternative shapes such as will be more fully described hereinbelow.

Locking section 14 includes coil 22 integrally connected to end 24 at a distal end of device 10. End 24 is shown by way of example as straight, however one skilled in the art would appreciate that 24 may comprise other shapes as well, e.g., curved, sinuous, or an integral part of the coil itself Coil 22 spirals around end 24 in continuously increasing radii to substantially form an involute. As is well known an involute is a curve formed by the path followed by the end of a taunt string unwinding about a base circle. Coil 22 is sized to loosely receive a range of support members 26, for example a Christmas tree branch, hanging in a hook-like fashion thereon.

Figure 4:
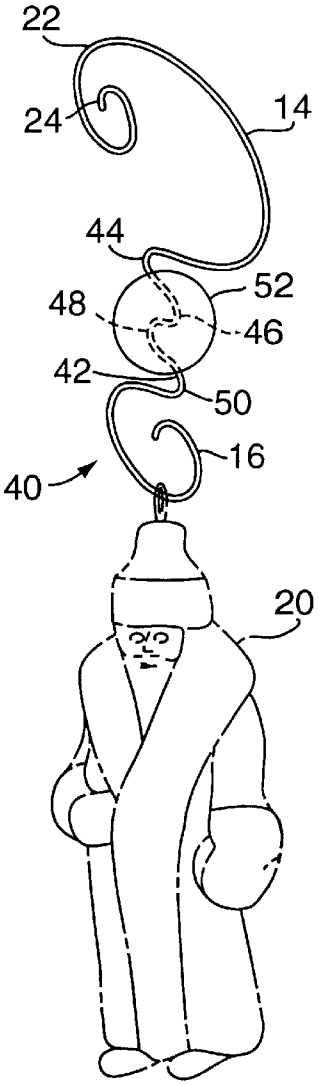
FIG. 4 is a perspective view of another alternative embodiment of a hanging device of the present invention showing an ornament hung thereon.
Figure 3:
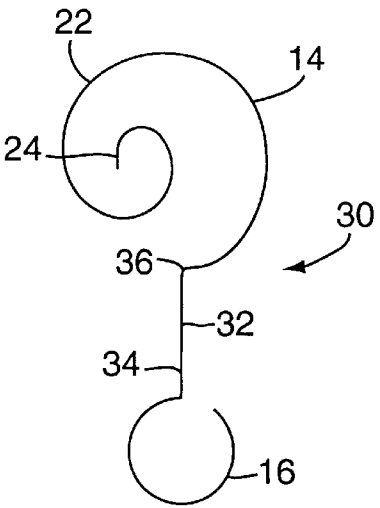
FIG. 3 is a side view of an alternative embodiment of a hanging device in accordance with the present invention.
Figure 2:
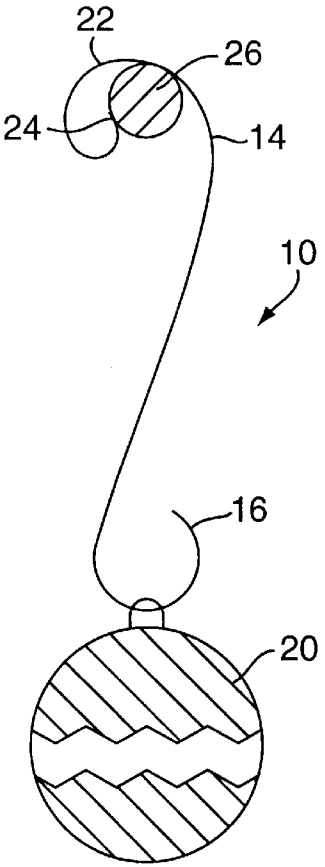
FIG. 2 is a side view of the hanging device of the present invention in an extended and locked position.

Referring to FIG. 2, hanging device 10 is shown in an extended and locked position. With ornament 20 disposed on hanging device 10, coil 22 of locking device 14 tends to unwind under the weight of the ornament, thereby extending and locking hanging device 10. As more weight is applied, either by application of a heavier ornament 20 or an external force, coil 22 unwinds even further, positioning branch 26 farther inside of the coil 22 and biasing the branch 26 between successive sections of the coil 22 having successively smaller radii. Therefore the greater the weight of ornament 20, the more locking device 14 tightens and increases the biasing force around support member 26. Referring to FIG. 3, an alternative embodiment of a hanging device of the present invention is shown generally at 30. Device 30 comprises locking portion 14 and object supporting portion 16 integrally connected therebetween by stem portion 32. Stem portion 32 includes a substantially straight stem section 34 and right angle bend 36. Right angle bend 36 is located proximate locking portion 14 and connects integrally thereto. Referring to FIG. 4, a second alternative embodiment of a hanging device of the present invention is shown generally at 40. Device 40 comprises locking portion 14 and object supporting portion 16 integrally connected therebetween by stem portion 42. Stem portion 42 is sinuous in shape, having a plurality of winding curves 44, 46, 48 and 50. Stem portion 42 further includes ornamental bead 52 mounted axially thereon.

The hanging device of the present invention is mounted as easily as a simple hook to the branch of a Christmas tree or other similar support. However, the locking device of the present invention securely grips the branch to substantially reduce the possibility of Christmas tree ornaments or other similar objects slipping off. Advantageously, the locking device requires no additional manipulation in order to attach to the branch. Additionally, in contrast to some prior art locking devices, as described hereinbefore, e.g. clips or gripping devices, the locking portion 14 and the object supporting portion 16 axially align with ornament 20 when the hanging device 10 is in the locked position increasing the stability of the device/ornament combination and having greater aesthetic appeal.

While exemplary embodiments have been described, by way of example, to a hanging device for Christmas tree ornaments, one skilled in the art would recognize that the invention applies to other applications as well for supporting a variety of objects, (e.g., for hanging sun catchers) on a range of supporting members.

It will be understood that a person skilled in the art may make modifications to the preferred embodiment shown herein within the scope and intent of the claims. Therefore, while the present invention has been described as carried out in a specific embodiment thereof, it is not intended to be limited thereby but is intended to cover the invention broadly within the scope and spirit of the claims.

What is claimed is:

1. A hanging device for hanging an object from a support member having a member width, said device comprising:

a locking portion having a coil spiraling around an end in continuously increasing radii to form successive sections of coil, said largest successive sections of coil defining an opening greater than that of said member width, said locking portion adapted to be hung in a hook-like fashion from said support member solely by loosely receiving said support member through said opening; and an object supporting portion integrally connected to said locking portion, said supporting portion adapted to have said object hung therefrom, wherein said locking portion will increasingly lock against said support member solely by weight of said object biasing said support member between said successive sections of coil, to frictionally retain the support member therebetween.

2. The device of claim 1 wherein said device is comprised of a resilient material.

3. The device of claim 1 further including a stem portion integrally connecting said object supporting portion to said locking portion.

4. The device of claim 3 wherein said stem is substantially straight.

5. The device of claim 3 wherein said stem includes at least a right angle bend.

6. The device of claim 3 wherein said stem includes a sinuous shape.

7. The device of claim 3 further including at least one ornament disposed on said stem.

8. The device of claim 1 wherein said coil substantially forms an involute.

9. The device of claim 8 wherein said involute is formed from a base circle having a diameter ranging from about ¼ inch to about 1¼ inch in diameter.

10. The device of claim 1 wherein said resilient material is selected from the group consisting of spring steel, stainless steel and plastic.

11. The device of claim 1 wherein said coil comprises a wire.

12. The device of claim 1 wherein said object supporting portion has a substantially circular shape.

13. The device of claim 12 wherein said substantially circular shape has a diameter ranging from about ¼ inch to about 1¼ inch.

14. The device of claim 1 wherein said object further comprises an ornament and said support member further comprises a Christmas tree branch.

15. A hanging device for hanging an ornament from a Christmas tree branch having a branch width, said device comprising:

a locking portion having a coil spiraling around an end in continuously increasing radii to form successive sections of coil, said largest successive sections of coil defining an opening greater than that of said branch width, said locking portion adapted to be hung in a hook-like fashion from said branch solely by loosely receiving said branch through said opening; and an ornament supporting portion adapted to have said object hung therefrom, wherein said locking portion will increasingly lock against said branch solely by weight of said ornament biasing said branch between said successive sections of coil, to frictionally retain the branch therebetween; and a stem portion integrally connecting said locking portion to said ornament supporting portion.

16. The device of claim 15 wherein said device is further comprised of a resilient material.

17. The device of claim 16 wherein said resilient material further comprises spring steel wire.

18. The device of claim 15 wherein said coil substantially forms an involute, the involute formed from a base circle having a diameter of about ¼ inch to about 1¼ inch.

19. The device of claim 15 wherein said ornament supporting portion further comprises a substantially circular shape, said shape having a diameter of about ¼ to about 1¼ inch.

* * * * *

UNITED STATES PATENT AND TRADEMARK OFFICE

CERTIFICATE OF CORRECTION

PATENT NO. : 6,155,526

DATED : December 5, 2000

INVENTOR(S) : John P. Brown

It is certified that error appears in the above-identified patent and that said Letters Patent is hereby corrected as shown below:

Claim 15:

Column 4, line 12, please delete "object" and insert --ornament-- therefor.

Signed and Sealed this

First Day of May, 2001

*Attest:*

Nicholas P. Godici

NICHOLAS P. GODICI

*Attesting Officer*

*Acting Director of the United States Patent and Trademark Office*